US006631609B2

(12) United States Patent
Scheunemann

(10) Patent No.: US 6,631,609 B2
(45) Date of Patent: Oct. 14, 2003

(54) METHOD AND STRANDING DEVICE FOR PRODUCING A CABLE OR A CABLE ELEMENT

(75) Inventor: Wolfgang Scheunemann, Herne (DE)

(73) Assignee: Drahtseilerei Gustav Kocks GmbH & Co., Mulheim an der Ruhr (DE)

( * ) Notice: Subject to any disclaimer, the term of this patent is extended or adjusted under 35 U.S.C. 154(b) by 0 days.

(21) Appl. No.: 10/156,068

(22) Filed: May 28, 2002

(65) Prior Publication Data

US 2002/0144497 A1 Oct. 10, 2002

Related U.S. Application Data

(63) Continuation of application No. PCT/EP00/11679, filed on Nov. 23, 2000.

(30) Foreign Application Priority Data

Nov. 25, 1999 (DE) ..... 197 56 736

(51) Int. Cl.[7] ..... D02G 3/32

(52) U.S. Cl. ..... 57/241; 57/258; 57/282; 57/295; 57/309; 57/314

(58) Field of Search ..... 57/58.49, 58.52, 57/59, 64, 236–238, 241, 243, 244, 250, 258, 282, 295, 309, 314

(56) References Cited

U.S. PATENT DOCUMENTS

| | | | | |
|---|---|---|---|---|
| 2,343,892 A | | 3/1944 | Dodge et al. | |
| 3,889,455 A | * | 6/1975 | Portinari et al. | 156/48 |
| 4,095,404 A | * | 6/1978 | Babayan | 57/297 |
| 5,683,642 A | * | 11/1997 | Muguruma et al. | 264/176.1 |
| 5,791,135 A | * | 8/1998 | Greenberg | 28/285 |
| 6,098,932 A | * | 8/2000 | Olesen | 241/16 PB |
| 6,378,283 B1 | * | 4/2002 | Barton | 57/58.49 |

FOREIGN PATENT DOCUMENTS

| | | | |
|---|---|---|---|
| DE | 1 250 626 | 4/1964 | |
| DE | OS 23 26 742 | 12/1974 | |
| DE | 35 10 808 A1 | 3/1985 | |
| DE | 89 12 221 U1 | 1/1990 | |
| EP | 0 252 830 A1 | 1/1988 | |
| EP | 0 375 896 A2 | 4/1990 | |
| EP | 375896 A2 * | 7/1990 | B29C/35/02 |
| EP | 0 672 781 A1 | 2/1995 | |
| EP | 0 731 209 B1 | 9/1996 | |
| EP | 1 022 377 A1 | 1/1999 | |
| FR | 2 711 997 A1 | 5/1995 | |
| JP | 57 21 00 89 A | 12/1982 | |
| WO | WO 98/16681 A2 | 4/1998 | |

* cited by examiner

*Primary Examiner*—Gary L. Welch
*Assistant Examiner*—Shaun R Hurley
(74) *Attorney, Agent, or Firm*—Wolf, Greenfield & Sacks, P.C.

(57) ABSTRACT

A method for producing a cable or cable element from individual elements is provided. The method comprises heating the individual elements before or during a stranding process until they are at least close to plastification and cooling the individual elements to a solidification temperature of a plastic. A cable or cable element comprising individual elements that are twisted together to form the cable is also disclosed. The individual elements are heated either before or during a stranding process until they are at least close to plastification, and are subsequently cooled to a solidification temperature of the plastic until they leave a stranding machine. A stranding device for the production of a cable or cable element from individual elements is also disclosed. The stranding device comprises a heating device which acts on the individual elements and a cooling device located downstream of the heating device in a direction of processing.

16 Claims, 3 Drawing Sheets

METHOD AND STRANDING DEVICE FOR PRODUCING A CABLE OR A CABLE ELEMENT

RELATED APPLICATIONS

This application is a continuation under 35 U.S.C. §120 of International Patent Application Serial No. PCT/EP00/11679, filed Nov. 23, 2000, which claims foreign priority benefits under 35 U.S.C. §119(a)–(d) or 35 U.S.C. §365(b) of German application number DE19956736.0, filed Nov. 25, 1999.

FIELD OF THE INVENTION

The field of the invention is a cable element and method for making such cable, comprising strands of plastic bearing fibres and a thermoplastic material.

DESCRIPTION OF THE RELATED ART

In addition to cables which have been known for a long time and are generally composed of numerous individual steel wires stranded together in a helical manner, plastic cables have recently become more significant since they can be provided with a similar tensile strength to that of wire cables, but have, however, a lower specific density. The strands of such a cable are built in such a way that high-strength synthetic fibres, for example aramide fibres, are at least partially covered with a plastic material so that the individual fibres cannot rub directly against one another, thereby significantly increasing the breaking strength and other characteristics.

DE-AS 12 50 626 discloses a method for producing chords of weldable or sealable plastic, in which a thermoplastic sheet material or a plastifiable coat of lacquer is heated. EP 0 672 781 A1 discloses a method for producing a plastic cable in which the strands are embedded in a plastic material to protect the individual fibres.

U.S. Pat. No. 4,095,404 discloses a method of manufacturing a cable, in which multi-filament yarns are first impregnated with a thermoplastic resin. The yams are first twisted into a helix assembly and then heated so as to fuse the resin coatings of the yarns. Afterwards the heated assembly is cooled so that the coatings of the filaments bond together to form a matrix for the the twisted filaments.

Herein, the individual elements, i.e. the strands, the bearing components of which are synthetic plastic fibres, are twisted in a helical manner, with the fibres being embedded in a plastic material for protection. The problem with regard to the strands is that, on the one hand, they can kink during the stranding process if the individual strands are forced into comparatively narrow radiuses of curvature so that the tensile strength of the cable and other characteristics, such as durability when running over cable pulleys, are no longer guaranteed.

On the other hand, the individual elements do not necessarily assume the helical form which they have to display in the finished cable or cable element, during the stranding process. Rather, they would reassume their straight form if they were to be removed from the cable following the stranding process. For the cable or cable element, this means that the individual elements are exposed to internal stress which leads to the cable or cable element being subjected to a torsional force. Such a torsional force in the cable is undesirable because this will cause the cable to twist. As a consequence, this could result in a shorter service life as well as in differences in length between the individual elements of the cable, for example, between the inner and outer layers of the cable. This is a most undesirable condition. Problems in assembly could also arise.

A certain amount of the internal stress can be reduced in the plastic fibre cable, which has been produced in the normal way, if the finished cable or cable element is stored for a specific period of time (for example one week to one month), during which the plastic material used is able to creep. Alternatively, the finished cable or cable element can be subjected to a heat treatment in a heated oven. However, the problem remains that the individual elements only partially assume the form that they should assume during the production of the cable and up to at least one week thereafter.

Thus, the quality and the load-bearing capacity of a cable produced in this manner can only be assessed following the described period of storage or heat treatment. There is no possibility of intervening in the production process at a point when the characteristics of the finished cable could still be altered to take into consideration requirements.

In a cable according to DE 35 10 808 A1, in which the bearing fibres are coated with a plastic material, the requirement that the individual elements be stress-free is also only achieved by means of the described unsatisfactory measures. This is particularly true in multi-step production methods in which an extrusion process occurs following the stranding of individual strands, by means of which the strands are coated with a plastic material, and subsequently the strands are twisted into a cable which is in turn coated with a suitable material, by extrusion if necessary.

These shortcomings are also true for the cable according to WO 98/16681, in which the individual chords are surrounded by coatings.

It is furthermore known, that a good embedding of strands in the coating of an inner portion of a cable can be achieved by heating the coating material of the inner portion and thus somewhat softening it, and by twisting the strands in this condition. However, not enough heat is released to the strands from the coating in this manner in order for the strands to be twisted in an admissible way without kinks, and so that the strands display the preferred form in the finished cable without internal stress occurring.

SUMMARY OF THE INVENTION

An embodiment of the invention provides a method for producing a cable or cable element and a corresponding stranding device by which a cable or cable element, comprising individual elements of plastic bearing fibres and a thermoplastic material which at least partly surrounds the plastic bearing fibres can be produced. The cable is produced according to this method without the storage or heat treatment required according to the prior art, and the characteristics and load-bearing capacity can be controlled during production.

According to an embodiment of the invention, a method for producing a cable or cable element from individual elements is provided. The individual elements comprise strands of a combination of plastic bearing fibres and a thermoplastic material which at least partially surrounds the plastic bearing fibres. The method comprises heating the individual elements before or during a stranding process until they are at least close to plastification, and cooling the individual elements to a solidification temperature of a plastic until they leave a stranding machine.

According to another embodiment of the present invention a cable or cable element comprises individual elements.

The individual elements, which are twisted together to form the cable or cable element, comprise strands of plastic bearing fibres and a thermoplastic material which at least partially surrounds the plastic bearing fibres. The individual elements are heated before or during a stranding process until they are at least close to plastification, and are subsequently cooled to a solidification temperature of the plastic until they leave a stranding machine, such that the individual elements are present in the cable or cable element largely without internal stress.

According to yet another embodiment of the present invention, a stranding device for the production of a cable or cable element from individual elements is provided. The individual elements comprise strands of plastic bearing fibres and a thermoplastic material which at least partially surrounds the plastic bearing fibres. The stranding device comprises a heating device which acts on the individual elements and a cooling device located downstream of the heating device in a direction of processing.

BRIEF DESCRIPTION OF THE DRAWINGS

The invention is described in more detail below by means of an embodiment, for example, with reference to the drawings in which:

FIGS. 3*a* and 3*b* show alternatives for a heating device of the stranding device according to an embodiment of the present invention.

DETAILED DESCRIPTION OF A PREFERRED EMBODIMENT OF THE INVENTION

Figure 1:
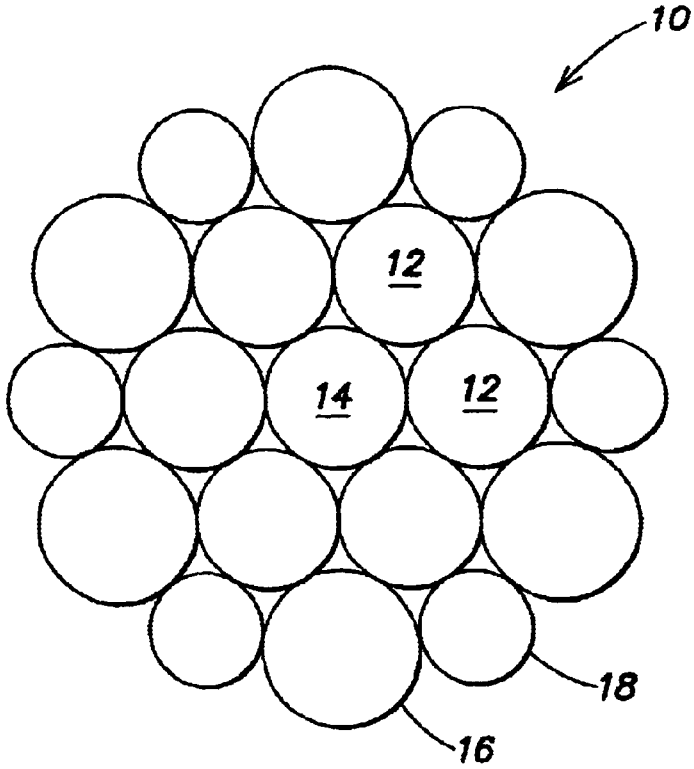
FIG. 1 shows, for example, a cross-section through a cable produced using the method according to the invention.

In a method according to an embodiment of the invention for producing a cable or cable element consisting of a combination of bearing fibres and a thermoplastic material which at least partly surrounds the bearing fibres, the individual elements, in particular the strands, are heated during the stranding process, until they are at least close to plastification so that the plastic material is at least close to plastification.

It must be noted that according to the invention, the strands do not have to be manufactured into a cable. Rather, it must be noted that typically the strands are themselves formed of several individual fibres which are at least partly coated with a suitable plastic material, if plastic fibres are used.

Generally, the individual fibres form the individual elements of a strand generated in this manner, which is twisted into the finished cable together with other strands. Thus, an individual element of a cable or a single strand should be generally understood to be a "strand" in the following description.

This almost plastification, or partial or complete plastification, which usually only concerns the plastic surrounding the fibres and, for the most part, not the fibre itself, results in the strands, or the cable elements of a plastic cable in general, which are constructed in the manner described, being deformable to a certain extent. Therefore, the strands can be brought into the form that they display in the finished cable or cable element during the stranding process without causing compulsive forces which cause internal stress in the strands. Subsequently, the individual element heated to near to or above the plastifying point of the thermoplastic material used is cooled into the form in which it is present in the finished cable element or cable. The formed design is hereby frozen to a certain extent, without the cable being able to twist freely.

Typically, according to an embodiment of the invention, the plastic is merely softened and not fused. Adjacent individual elements do not bond together. Rather, they keep their individual character and are individually deformed during the stranding process. Also in the complete cable, individual elements are not bonded together. Rather, they stay apart from each other and are, for example, moveable relative to each other. Generally, the individual elements are heated to a temperature of approximately 60 to 80 degrees Celsius. Accordingly, the cable or cable element according to an embodiment of the invention is comprised of individual elements which are separate from each other, moveable relative to each other, and not bonded together.

Consequently, the strand is largely free from internal stress in the cable, and thus the cable has a low number of twists or is twist-free. This means that a strand or an individual element in general would maintain its helical form if it was removed from the cable formation. Furthermore, the lacing at the end of the cable can be solved using the cable or cable element according to the invention, which has a low number of twists or is twist-free, and the individual strands or individual elements would not leave or "burst open" the cable formation, or would only to a small extent. In particular, by using the method according to the invention, the low-twist or twist-free condition is already in existence directly after the stranding process, and thus the cable or cable element can be further processed immediately. Furthermore, in contrast to the prior art, it is immediately possible to make a quality assessment right at the beginning of production, and thus it is possible to immediately intervene in the production process if necessary to make corrections. According to the prior art, quality can only first be assessed following the required period of storage or heat treatment, and thus a considerable amount of waste is unavoidable and productivity as a whole is reduced. If necessary, the characteristics of the prepared cable or cable element can still be influenced during production in the method according to the invention, and thus operation can be carried out with higher productivity. In particular, in contrast to the prior art, the finished cable or cable element consistently has an extremely low torsional force.

This furthermore prevents the finished cable or cable element from changing its geometry, and a reduced service life as well as a safety risk for the end users can be ruled out. In particular, the invention comprises heating the strands to guarantee the predictable characteristics of the finished cable or cable elements, which differs considerably from the measure of heating the coating of a layer lying therebeneath for an improved embedding of the strand twisted thereon, which is known from the prior art, and leads to basic advantages.

Aramide fibres, for example, are suitable as the plastic bearing fibres of a cable or cable element produced using the method according to the invention. One aramide fibre is known, inter alia, under the brand name Kevlar. Polyurethane, for example, is suitable as the thermoplastic material which surrounds the bearing fibres at least partially in order to reduce rubbing between the bearing fibres, and thus, as a whole, to guarantee the tensile strength and the preferred coefficients of friction relative to cable pulleys, etc. However, polyethylene, polypropylene, fluroplastics, thermoplastic polyester, thermoplastic rubber-like polyester, ethylene copolymers, poly-vinyl polymers and copolymers, for example, could also be used. The pre-treatment of the plastic bearing fibres with the thermoplastic material may consist of, for example, embedding the plastic bearing fibres in the plastic. Alternatively, it is possible to coat the bearing fibres or even individual strands with the thermoplastic material by means of an extrusion process.

It is preferable for the implementation of the invention that the cable or the cable element be produced from individual elements which comprise a portion of thermo plastic material, which, according to the prior art, can only achieve a stress-free condition by means of longer storage or heat treatment. The production of a largely stress-free plastic fibre cable is made possible by the invention.

The method according to the invention and the corresponding device is thus intended and suitable in particular for those plastic fibre cables described in DE, 35 10 808 A1, EP 0 252 830 A1, WO 98/16681, EP 0 672 781 A1 and EP 0 731 209 B1, the full content of the disclosures of which are herein incorporated by reference.

An additional advantage can be realised if the strands are heated before the stranding process. The strand is in an at least partially plastified and easily deformable condition at the point in time when it is deformed with particularly narrow radiuses of curvature due to the helical turn of the cable. In contrast to the stranding process according to the prior art, kinks in the strands can be avoided according to the invention, due to a reduction of the tensile strength of the finished cable or cable element.

Particularly good results for a twist-free condition of the prepared cable or cable element can be expected if the strands, which are at least close to plastification, are cooled to below the solidification temperature before the end of the stranding process, and thus to a certain extent still inside the stranding machine. It is hereby impossible for the strand to twist itself freely at any point, but is instead maintained in the form which it assumes in the finished cable or cable element, and thus the stress-free condition of the strand is guaranteed with greater certainty.

In a cable produced according to an embodiment of the invention by means of the method described above, the strands are heated until they are at least close to plastification so that the strands are present in the finished cable without any kinks and are in the preferred form. A cable produced by the method according to an embodiment of the invention is thus particularly recognisable by the fact that strands which were twisted with narrow radiuses of curvature also have no kinks, and they are also in the form preferred in the finished cable to guarantee a largely twist-free condition, directly after it has left the stranding machine.

Consequently, a stranding device in accordance with an embodiment of the invention comprises a heating device which acts on at least one portion of the strands or individual elements used. As specified above, the plastic used for surrounding or embedding the bearing plastic fibres can be at least close to plastification so that the individual strands can be bought into the form which they assume in the prepared cable or cable element in a stress-free condition.

The preferred rapid cooling of the heated strands to a lower temperature may be achieved by the fact that the strands twisted into the cable come into contact with cold machine parts, and thus cooling results. It is, however, preferred that a cooling device is provided in the stranding device according to an embodiment of the invention, which acts on the strand manufactured into the cable or cable element and is located downstream of the heating device in the direction of processing.

Supplies of hot air are particularly suitable with regard to the embodiment of the heating device.

Alternatively, a heating device which is designed in such a way that it delivers radiant heat to the strands to be manufactured, is possible.

Finally, the heating device can also be realised in such a way that it comprises a naked flame which acts on the stands in such a way that the strands are at least partially plastified.

The cooling device can, for example, be provided as a cooling air blower or as a device which supplies the prepared cable with a cooling liquid, such as water, so that the strands are set in the form which they assume in the cable.

Due to the fact that strands which have been at least partially plastified by heat by means of the stranding device according to the invention should be used, a material is preferred for the so-called clamping jaws. Materials which are suitable are, for example, steel, Teflon-coated steel, ceramics and suitable plastics. Polyamide, for example, is particularly suitable as a clamping jaw material.

Clamping jaws can support both the heating and the cooling of the strands by incorporating a corresponding heating or cooling device.

FIG. 1 shows a cable formation 10 in which individual elements or strands 12 are twisted around an inner element 14. This results in narrow radiuses of curvature which can lead to kinks in the strands 12. According to an embodiment of the invention, the thermoplastic material provided in or around these strands 12 is almost or partially or completely plastified so that the thermoplastic material can be brought into the preferred form without the risk of kinks and without any compulsive forces being exerted on the cable or cable element following cooling.

This is also true for the stranding of the outer strands 16 and 18 around the inner portion consisting of strand 12 and the innermost element 14. The outer strands 16 and 18 must also be bent around narrow radiuses of curvature in this arrangement, with the method according to the invention also largely preventing torsional forces from occurring in the cable. Thus, the quality of the cable can immediately be assessed and the cable or the cable element can immediately be processed further.

It is to be appreciated that the cable structure shown in FIG. 1 is one example. In particular, the radiuses of curvature provided during the stranding process are comparatively small for strands 12. In contrast, the closer to the outside of the cable structure the greater the influence of internal stress on the twisting behaviour of the cable becomes. Correspondingly, with regard to the twisting behaviour of the cable, it is advantageous for the strands lying further to the outside to be heated before or during the stranding process in accordance with the invention.

Figure 2:
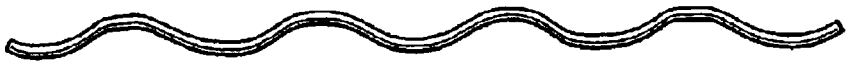
FIG. 2 shows a side view of a strand removed from a cable produced by means of the method described shortly after the stranding process.

In a schematic side view, FIG. 2 shows a three-dimensional helix or spiral which is assumed shortly after the stranding process by a strand that is removed from the cable produced according to the invention. As can be seen from the schematic diagram, the strand is in the form preferred for the strand to be present in the finished cable without internal stress. As a result, the finished cable is largely free from torsional force. It must also be noted that the plastic of the strand should only be heated until it is sufficiently able to creep so that the strand can assume the preferred form despite the comparatively rapid speed of the stranding process. As is mentioned above, this creeping is only possible with subsequent heating or longer storage according to the prior art.

Figure 3:
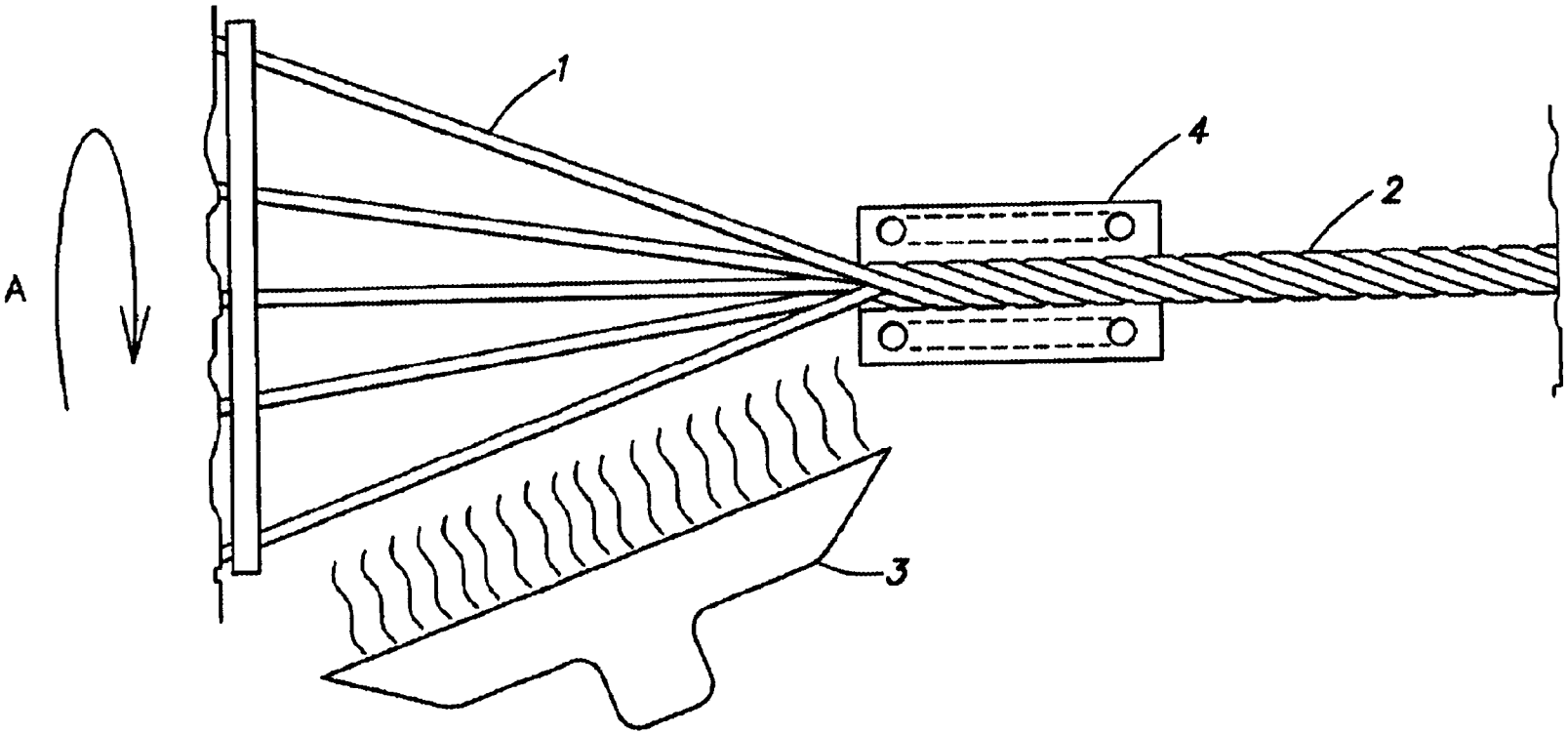
FIG. 3 shows a side view of a section of a stranding device according to an embodiment of the invention.
Figure 5:
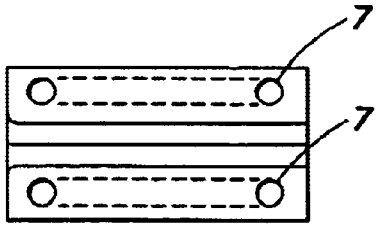
FIG. 5 shows clamping jaws of a stranding device according to an embodiment of the invention.

FIG. 3 shows a side view of a section of a stranding device according to an embodiment of the invention. In a first section, not shown in detail in the figure, individual elements of a cable which is to be produced are twisted in the direction of arrow A. By means of clamping jaws 4, individual elements 1 are pressed or clamped to form in the cable 2. Reference numeral 3 indicates a heating device, in this case a device which is adapted to release radiant heat. As shown in more detail in FIG. 5, the clamping jaws are made up of two pieces which are combined with each other to form an arrangement that completely surrounds the cable which is to be produced. Furthermore, the clamping jaws 4 comprise drill holes 7 through which a cooling medium, such as water, air or a similar medium, can be circulated.

Figure 4A:
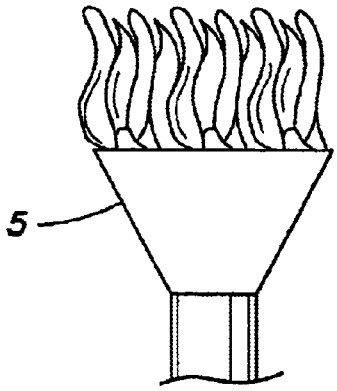
FIGS. 4*a* and 4*b* show alternatives for a heating device of the stranding device according to an embodiment of the present invention.
Figure 4B:
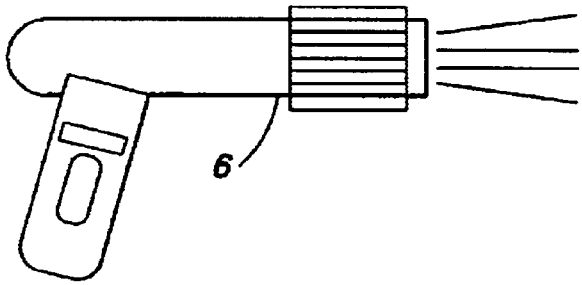

FIG. 4*a* shows, as an alternative to the heating device 3 shown in FIG. 3, a heating device comprising a naked flame. FIG. 4*b* shows, as a another possible alternative to the heating device, a device 6 which is adapted to release hot air.

Having thus described several illustrative embodiments, various alterations, modifications and improvements will readily occur to those skilled in the art. Such alterations, modifications, and improvements are intended to be within the spirit and scope of the invention. Accordingly, the foregoing description is by way of example only and is not intended as limiting.

What is claimed is:

1. A method for producing a cable or cable element from individual elements the individual elements comprising strands of a combination of plastic bearing fibres and a thermoplastic material which at least partially surrounds the plastic bearing fibres, the method comprising:

heating the individual elements before or during a stranding process until they are at least close to plastification; and cooling the individual elements to a solidification temperature of the thermoplastic material until they leave a stranding machine.

2. The method of claim 1, wherein the act of cooling comprises cooling the strands to the solidification temperature before an end of the stranding process.

3. A cable or cable element comprising:

individual elements that are twisted together to form the cable or cable element, comprising strands of plastic bearing fibres embedded in a thermoplastic material which at least partially surrounds the plastic bearing fibres;

wherein the individual elements are heated before or during a stranding process until they are at least close to plastification; and the individual elements are subsequently cooled to a solidification temperature of the plastic until they leave a stranding machine, such that the individual elements are present in the cable or cable element largely without internal stress.

4. The cable of claim 3, wherein the cable is a load-bearing cable.

5. A stranding device for the production of a cable or cable element from individual elements, the individual elements comprising strands of plastic bearing fibres and a thermoplastic material which at least partially surrounds the plastic bearing fibres, the stranding device comprising:

a heating device which acts on the individual elements to heat individual elements to at least close to a plastification temperature of the thermoplastic material; and a cooling device located within the stranding device and downstream of the heating device in a direction of processing, that cools the individual elements to a solidification temperature of the thermoplastic material.

6. The stranding device of claim 5, wherein the heating device provides hot air.

7. The stranding device of claim 4, wherein the heating device provides radiant heat.

8. The stranding device of claim 5, wherein the heating device comprises a flame.

9. The stranding device of claim 5, wherein the cooling device comprises a cooling air blower.

10. The stranding device of claim 5, further comprising clamping jaws.

11. The stranding device of claim 10, wherein the clamping jaws comprise the heating device.

12. The stranding device of claim 10, wherein the clamping jaws are composed at least partially of one of steel, Teflon-coated steel, ceramics, plastic, or a polyamide.

13. The stranding device of claim 5, wherein the cooling device delivers a cooling liquid to the cable or cable element.

14. The stranding device of claim 10, wherein the clamping jaws comprise the cooling device.

15. The stranding device of claim 5, wherein the stranding device is adapted to produce a load-bearing cable.

16. A method of producing a cable comprising a plurality of strand, the method comprising acts of:

heating individual elements that comprise a combination of plastic, load-bearing fibers at least partially embedded in a thermoplastic material to a temperature sufficient to cause plastification of the thermoplastic material;

standing the individual elements to form strands using a stranding device; and subsequently cooling the individual elements using a cooling device, to a solidification temperature of the thermoplastic material before the individual elements exit the stranding device.

* * * * *

UNITED STATES PATENT AND TRADEMARK OFFICE

CERTIFICATE OF CORRECTION

PATENT NO. : 6,631,609 B2
DATED : October 14, 2003
INVENTOR(S) : Scheunemann

It is certified that error appears in the above-identified patent and that said Letters Patent is hereby corrected as shown below:

Title page,
Item [30], Foreign Application Priority Data, number should be -- 199 56 736 --.

Column 7,
Line 37, insert a comma after the word "elements" (first usage).

Column 8,
Line 24, "claim 4" should read -- claim 5 --.
Line 29, "claim 5" should read -- claim 8 --.
Line 45, "A method of" should read -- A method for --.
Line 46, "strand" should read -- strands --.
Line 52, "standing" should read -- stranding --.
Line 54, insert a comma after the word "elements" and before the word "using".

Signed and Sealed this

Second Day of March, 2004

JON W. DUDAS
*Acting Director of the United States Patent and Trademark Office*